US006261015B1

(12) United States Patent
McCauley et al.

(10) Patent No.: US 6,261,015 B1
(45) Date of Patent: Jul. 17, 2001

(54) ROLLER BALL PEN WITH ADJUSTABLE SPRING TENSION

(75) Inventors: Bernard J. McCauley, West Point, IA (US); Ryan S. Eddington, Dallas City, IL (US); Michael Huneke, Burlington, IA (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/493,922

(22) Filed: Jan. 28, 2000

(51) Int. Cl.[7] ..... B43K 24/02
(52) U.S. Cl. ..... 401/103; 401/116
(58) Field of Search ..... 401/103, 54, 259, 401/260, 209, 186, 188, 116

(56) References Cited

U.S. PATENT DOCUMENTS

| | | | | |
|---|---|---|---|---|
| 2,002,501 | | 5/1935 | Donato | 176/123 |
| 2,488,179 | * | 11/1949 | Engel, Jr. | 401/54 |
| 3,051,132 | | 8/1962 | Johmann | 120/42.03 |
| 3,144,005 | | 8/1964 | Johmann | 120/42.03 |
| 3,232,278 | * | 2/1966 | Johmann | 401/103 |
| 3,419,336 | * | 12/1968 | Kirk | 401/54 |

* cited by examiner

*Primary Examiner*—David J. Walczak
(74) *Attorney, Agent, or Firm*—Pennie & Edmonds LLP

(57) ABSTRACT

A roller ball pen that permits a user to adjust the bias force that biases a roller ball cartridge out of the pen to suit the user's particular writing style. The pen has a body having distal and proximal ends, a roller ball cartridge disposed in the body, a cap removably disposed on the proximal end of the body, a nut slidingly disposed in the cap, a spring attached to the distal side of the nut and abutting the roller ball cartridge, and a drive rod engaged with the nut. Rotation of the drive rod moves the nut distally or proximally, thereby adjusting the bias force applied by the spring to the roller ball cartridge.

27 Claims, 6 Drawing Sheets

ROLLER BALL PEN WITH ADJUSTABLE SPRING TENSION

FIELD OF THE INVENTION

The present invention relates generally to pens with replaceable roller ball cartridges.

BACKGROUND OF THE INVENTION

In general roller ball pens have a pen body in which a replaceable roller ball cartridge is held in place such that a user may write with the pen. The roller ball cartridge has a writing tip and a butt end. Usually the pen body has two pieces detachably held together by threads, for example. In order to replace the roller ball cartridge the two pieces are separated and the spent roller ball cartridge is removed and a replacement roller ball cartridge is inserted into one of the two pieces and the other piece is attached back into place. In some cases a spring or other biasing element abuts the butt end of the roller ball cartridge and the it inside of the body, such that the spring biases the writing tip out of the pen body. The spring or biasing element also provides a certain feel to the user, because, depending on the biasing force, the roller ball cartridge will have a certain recoil within the body while the user is writing with the pen. The prior art pens can only provide one tension, which is set by design, and a user must be satisfied with the feel of the particular pen chosen. Therefore, there is a need in the art for a roller ball pen for which the user can set the biasing force to meet the user's particular needs.

SUMMARY OF THE INVENTION

A preferred embodiment of roller ball pen includes a pen body with distal and proximal ends, a roller ball cartridge inserted into the pen body (with the writing end extending at least partially out of the distal end of the pen body), a cap detachably attached to the proximal end of the pen body, a drive rod rotatably fixed to the cap, a control member such as a nut, and a binsing element (preferably a spring) attached to the nut and abutting the butt end of the roller ball cartridge. Preferably the control member or nut is slidingly disposed within the cap such that it may move distally or proximally, but may not substantially rotate therein. The drive rod extends at least partially into the cap and is rotatably fixed thereto such that it may not substantially move distally or proximally. The distal end of the drive rod engages the nut, such that rotation of the drive rod will move the nut distally or proximally, thereby changing the biasing force of the spring against the roller ball cartridge. Preferably there is a drive knob fixed to the proximal end of the drive rod and the drive knob is ratatable to rotate the drive rod.

DETAILED DESCRIPTION OF THE PREFERRED EMBODIMENTS

Figure 1:
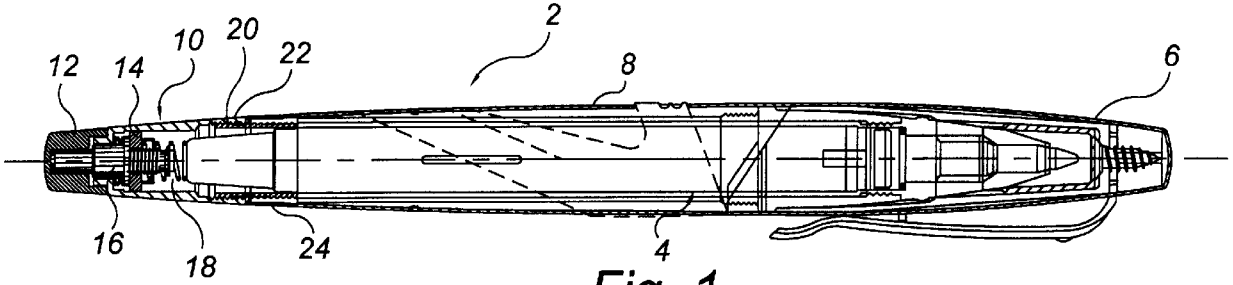
FIG. 1 is a roller ball cartridge pen with adjustable spring tension in accordance with an embodiment of the present invention.

Referring to FIG. 1 there is shown a pen 2 in accordance with an embodiment of the present invention. Pen 2 has roller ball cartridge 4, pen top 6, body portion 8 (also referred to herein as first part of body and distal part of writting instrument), cap 10 (also referred to herein as second part of body and proximal part of witing instrument), drive knob 12, control member of nut 14, drive rod 16 and spring 18. Bushing 20 is threaded and fixed into distal end 22 of cap 10 and proximal end 24 of body portion 8 is removably secured to cap 10 using bushing 20. Thus, a user may replace roller ball cartridge 4 by unscrewing body portion 8 from cap 10, removing the spent cartridge, inserting a new cartridge and screwing body portion 8 back to cap 10.

Figure 2:
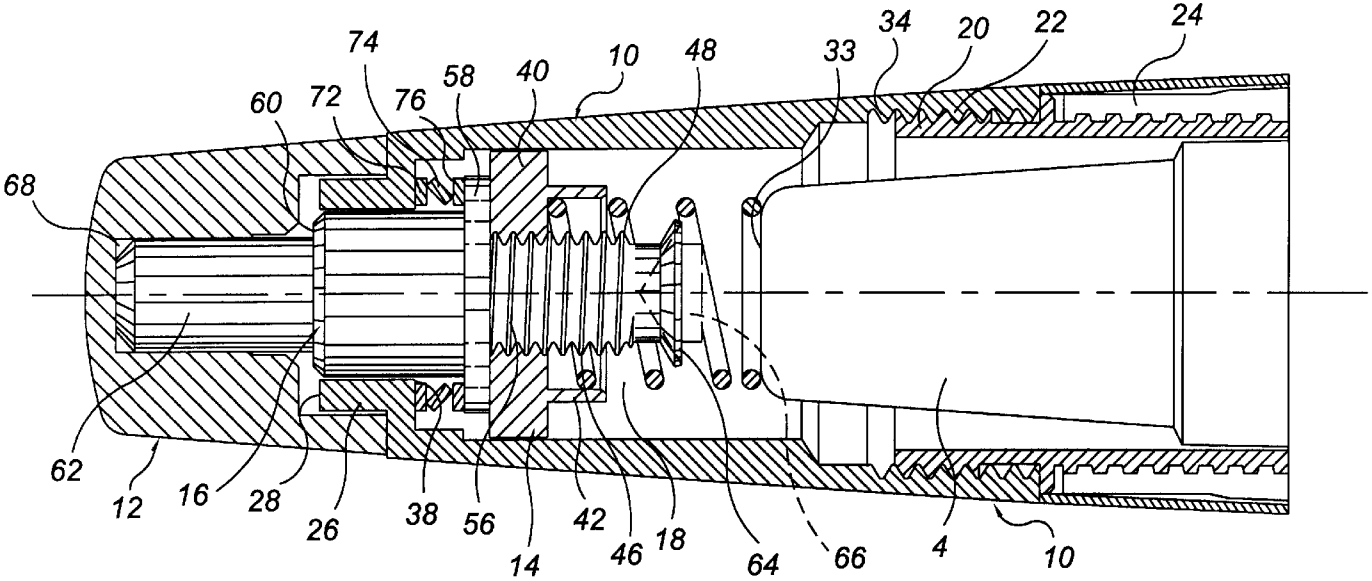
FIG. 2 is a cross-section of the proximal end of the pen of FIG. 1.
Figure 3:
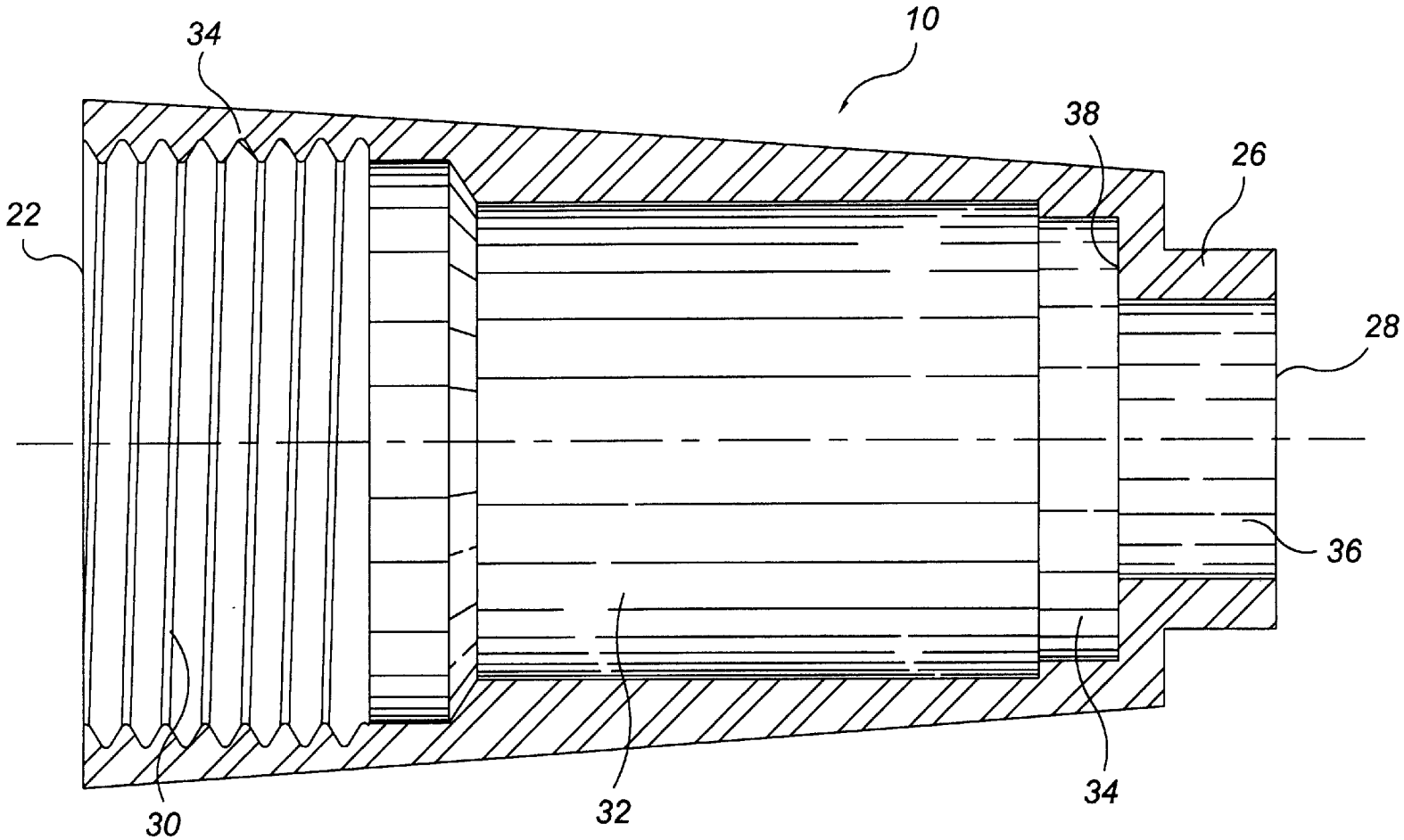
FIG. 3 is a cross-section of a cap of the pen of FIG. 1.

Referring to FIGS. 2 and 3, cap 10 preferably has a tapered cylindrical exterior shape with a straight cylindrical ring 26 at its proximal end 28, which has a smaller outer diameter than cap 10. The interior of cap 10 has first hollow section 30, second hollow section 32, cylindrical cavity 34, and hole 36. First hollow section 30 is configured to fit over butt end 33 of roller ball cartridge 4 and has threads 34 configured to mate with bushing 20, as described above. Second hollow section 32 is configured to receive and engage engagement portion 40 of nut 14, such that nut 14 will not rotate relative to cap 10 and such that nut 14 may move longitudinally within second hollow section 32. Preferably second hollow section 32 has eight sides (not shown) and slidingly receives and mates with nut 14, as described more fully below. A skilled artisan will readily recognize that many shapes other than the preferred eight-sided shape for second hollow section 32 may be used without exceeding the scope of the present invention. For example, and without limitation, any number-sided shape may be used, even as few as a two sided shape. Cylindrical cavity 34 has a smaller diameter than the nominal diameter of second hollow section 32, and a larger diameter than hole 36. The difference in diameters between cylindrical cavity 34 and hole 36 defines shoulder 38.

Figure 4:
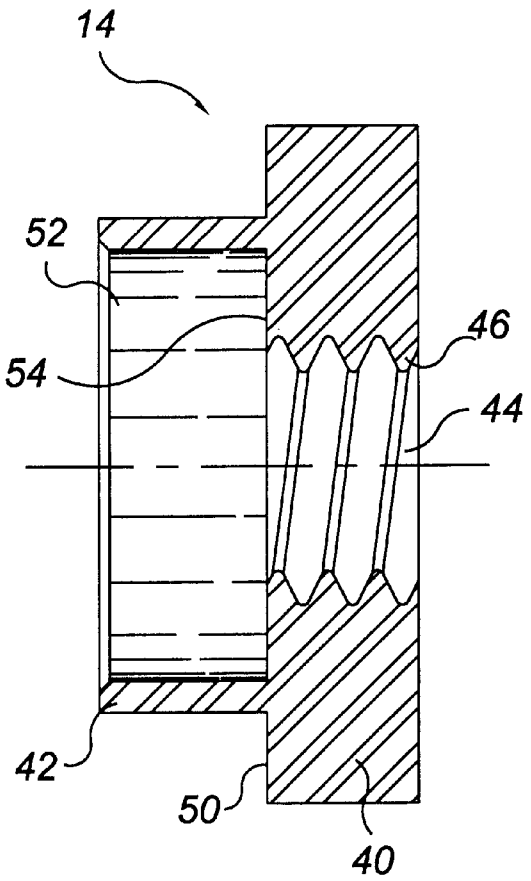
FIG. 4 is a cross-section of a nut of the pen of FIG. 1.

Referring to FIGS. 2 and 4, control member or nut 14 has engagement portion 40 and hollow cylinder 42. The exterior of engagement portion 40 is configured to engage second hollow section 32 of cap 10; preferably it has an octagonal shape as described above. Engagement portion 40 also has a hole 44 therethrough that has threads, 46 configured to engage threads 48 of drive rod 16, as more fully described below. Hollow cylinder 42 of nut 14 is attached to or integral with distal side 50 of engagement portion 40. The outer diameter of hollow cylinder 42 is smaller than the nominal outer diameter of engagement portion 40, and the inner diameter is larger than the diameter of hole 44, thereby defining spring cavity 52 with spring abutment 54. Spring cavity 52 is configured to receive and secure spring 18 against spring abutment 54. Preferably, the diameter of spring 18 is slightly larger than the inner diameter of hollow cylinder 42 and spring 18 is secured therein by friction. A skilled artisan will readily recognize other ways to secure spring 18 to nut 14.

Figure 5:
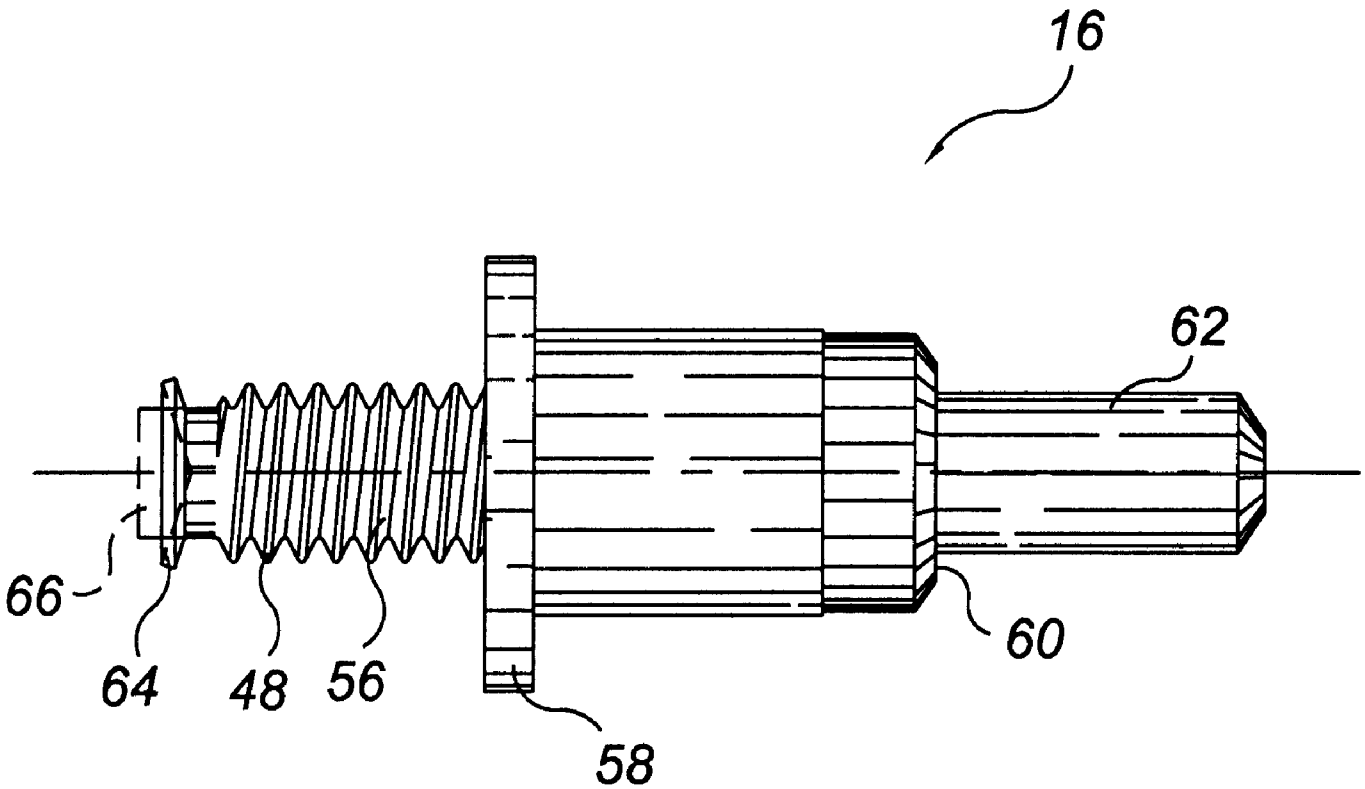
FIG. 5 is a cross-section of a drive rod of the pen of FIG. 1.

Referring to FIGS. 2 and 5, drive rod 16 has threaded portion 56, ring 58, ledge 60 and attachment section 62. Threaded portion 56, as shown, has threads 48 and stop 64. Prior to assembly of pen 2, stop 64 is a straight cylindrical portion 66, as shown in phantom. Once drive rod 16 is installed, straight cylindrical portion 66 is deformed to form stop 64, which prevents drive rod 16 from being completely removed from nut 14.

Figure 6:
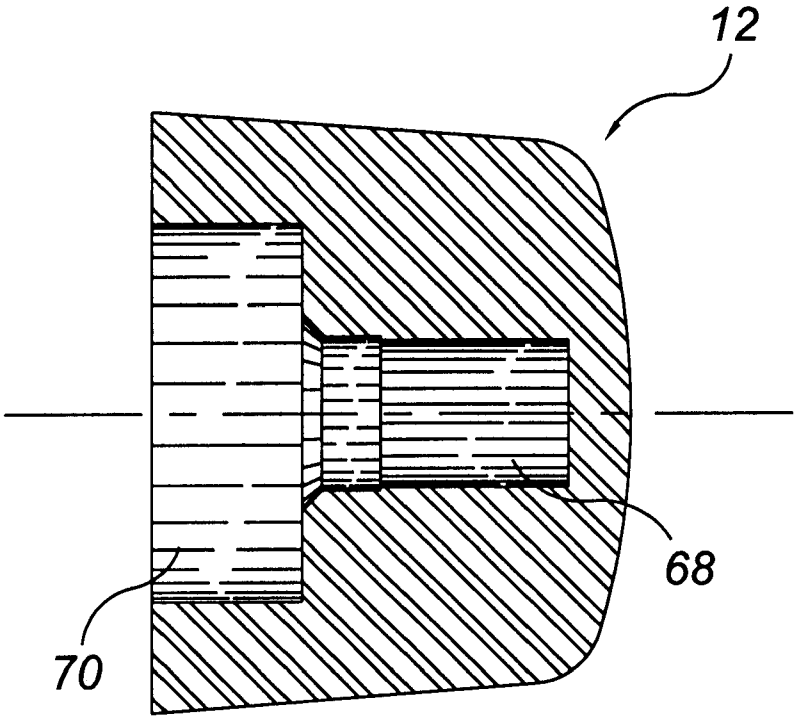
FIG. 6 is a cross-section of a drive knob of the pen of FIG. 1.
Figure 7:
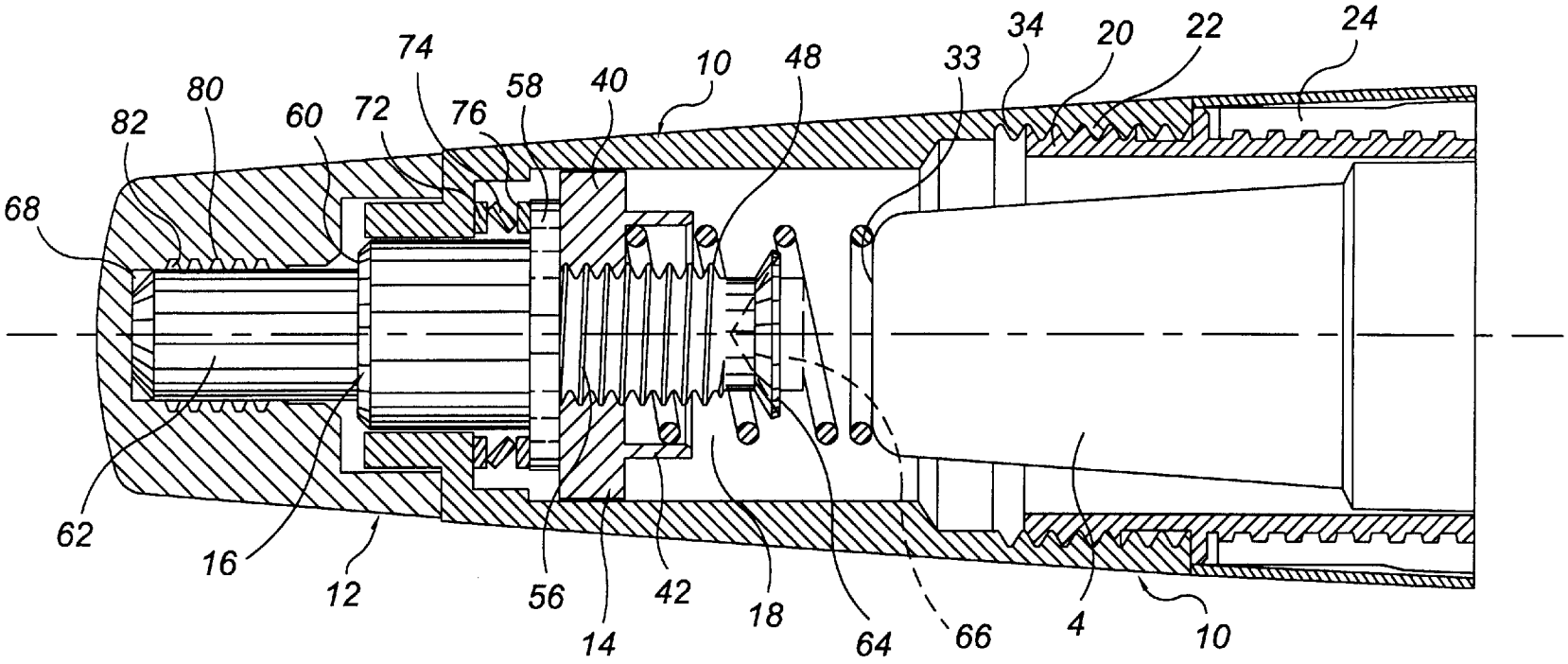
FIG. 7 is a cross-section of another embodiment of the proximal end of the pen of FIG. 1.

Referring to FIGS. 2 and 6, drive knob 12 has first cavity 68 and second cavity 70. First cavity 68 has a slightly smaller diameter than the diameter of attachment section 62 of drive rod 16 and at least the same length. Attachment section 62 is jammed into first cavity 68 of drive knob 12, thereby creating a friction connection between the two pieces. Preferably the surface of attachment section 62 is roughened to provide a better attachment. A skilled artisan will recognize many ways to attach drive knob 12 to drive rod 16, such as, and without limitation, threads 80, 82, as shown in FIG. 7, or adhesive. Second cavity 70 has an inside diameter that is larger than the outside diameter of straight cylindrical ring 26 of cap 10. Second cavity 70 fits over straight cylindrical ring 26 and is held in place by virtue of the attachment of drive knob 12 to drive rod 16, as further discussed below. The exterior of drive knob 12 is preferably tapered to follow the contours of the exterior of cap 10.

Referring to FIG. 2, first circular washer 72, spacer washer 74, and second circular washer 76 are inserted into cap 10, and abut against shoulder 38 of cap 10. Preferably spacer washer 74 is not a flat washer, but rather one with an undulating surface that provides some longitudinal movement when compressed. Attachment section 62 of drive rod 16 is inserted through and out of hole 36 of cap 10, and drive knob 12 is attached thereto, such that ring 58 of drive rod 16 abuts second circular washer 76. In this manner drive knob 12 and drive rod 16 are secured to cap 10. It should be noted that drive knob 12, while secured to cap 10, may freely rotate about its longitudinal axis. After drive rod 16 is installed, engagement portion 40 of nut 14 is inserted, such that the exterior of engagement portion 40 mates with second hollow section 32 of cap 10, as described above. Drive knob 12 is rotated to engage threads 46 of nut 14, thereby advancing nut 14 over drive rod 16 and into cap 10 in the proximal direction. Straight cylindrical portion 66 (shown in phantom) is deformed to create stop 64 that prevents nut 14 from coming off of drive rod 16 during use of the pen. Spring 18 is inserted over drive rod 16 and into hollow cylinder 42 of nut 14, and is secured thereto as described above. With roller ball cartridge 4 in place, cap 10 is attached to body portion 8, and spring 18 biases roller ball cartridge 4 in the distal direction. A user may adjust biasing force by turning drive knob 12 in one direction or the other, which rotates drive rod 16 and moves nut 14 either distally or proxinally, thus movement causes spring 18 to compress or decompress, thereby varying the biasing force exerted by spring 18 against roller ball cartridge 4 in accordance with a user's preferred feel.

The skilled artisan will readily recognize that ways other than using drive rod 16 in combination with nut 14 to adjust the tension of spring 18 may be used without exceeding the scope of the present invention. For example, and without limitation, drive knob 12 may be secured directly to cap 10, and have threads to engage with drive rod 16 such that rotation of drive knob 12 would cause drive rod 16 to move within cap 10. Another example would be a ratchet type mechanism.

The materials used to construct roller ball pens are well known in the art. In the present invention it is preferred to use plastic for body portion 8, and brass for cap 10, drive rod 16 and nut 14. As for the other parts of the present invention any suitable material known to those skilled in the art will suffice. Although various embodiments of the present invention have been described, the descriptions are intended to be merely illustrative. Thus, it will be apparent to the skilled artisan that modifications may be made to the embodiments as described without departing from the scope of the claims set forth below.

What is claimed is:

1. A writing instrument comprising:

a body with a distal end and a proximal end;

a cartridge with a writing end and a butt end, wherein said writing end extends at least partially out of said distal end of said body;

a cap detachably attached to said proximal end of said body;

a drive rod with a proximal end and a distal end, wherein said drive rod is coupled to said cap for rotating with respect to said cap without moving longitudinally;

a control member slidingly disposed in said cap, wherein said distal end of said drive rod engages said control member; and a biasing element positioned between said control member and said cartridge and configured to bias said cartridge in a distal direction;

wherein rotation of said drive rod moves said control member longitudinally within said cap, thereby varying the biasing force against said cartridge.

2. A writing instrument according to claim 1, further comprising:

a drive knob connected to said proximal end of said drive rod, such that rotation of said drive knob rotates said drive rod.

3. A writing instrument according to claim 2, wherein said control member has a hole therethrough with threads therein, and the proximal end of said drive rod has threads that engage the threads of said control member.

4. A writing instrument according to claim 3, further comprising:

a hollow cylinder attached to said distal end of said control member, wherein one end of said biasing element is inserted into said hollow cylinder and attached therein.

5. A writing instrument according to claim 4, wherein said biasing element is attached to said control member using friction.

6. A writing instrument according to claim 3, wherein said control member has an octagonally-shaped exterior, such that said control member is longitudinally but not rotatable movable within said cap.

7. A writing instrument according to claim 1, further comprising:

a drive knob with a threaded cavity therein, wherein said drive knob is rotatably fixed to a proximal end of said cap; and threads on said distal end of said drive rod, wherein said threads engage said threaded cavity of said drive knob, wherein rotation of said drive knob rotates said drive rod within said cap, thereby moving said control member either distally or proximally within said cap.

8. A writing instrument according to claim 1, wherein said control member is a nut and said cap has an interior configured and dimensioned to prevent said nut from rotating within said cap.

9. A writing instrument according to claim 1, wherein said biasing element is a coil spring.

10. A writing instrument comprising:

a cartridge having a writing end and a butt end;

a cap associated with said butt end of said cartridge;

a drive member rotatably positioned within said cap, said drive member being associated with said butt end of said cartridge at one end and extending from said cap at the other end;

a control member associated with said drive member and slidingly positioned within said cap, wherein said control member slides, but does not rotate within said cap when said drive member is rotated; and a biasing element positioned between said cartridge and said control member;

wherein said cap has a longitudinal axis and said drive remember is gubstatially immovable longitudinally relative to said cap.

11. A writing instrument according to claim 10, further comprising:

a body having a distal end and a proximal end, with said cartridge being positioned within said body such that said writing end extends at least partially outside of said distal end of said body; and wherein said cap is connected to said body at said proximal end of said body.

12. A writing instrument according to claim 11, wherein said cap is detachable relative to said body.

13. A writing instrument according to claim 10, wherein said control member is configured so that it does not rotate within said cap.

14. A writing instrument according to claim 10, wherein an interior of said cap is configured and dimensioned such that said control member does not rotate within said cap.

15. A writing instrument according to claim 10, wherein said biasing element is a spring that biases said cartridge in a direction away from said drive member.

16. A writing instrument according to claim 15, wherein rotation of said drive member causes said control member to move longitudinally within said cap, thereby compressing or decompressing said spring in order to vary the biasing force of said spring against said cartridge.

17. A writing instrument according to claim 16, wherein said control member is a nut and an interior of said cap is configured and dimensioned to prevent rotation of said control member within said cap but to allow said control member to slide longitudinally within said cap.

18. A writing instrument according to claim 10, further comprising a drive knob fixedly attached to said drive member and rotatably associated with said cap, wherein rotation of said drive knob causes rotation of said drive member.

19. A writing instrument according to claim 10, wherein said drive member further comprises a stop for preventing said control member from losing association with said drive member.

20. A writing instrument comprising:

a body with a distal end and a proximal end;

a cartridge with a writing end and a butt end, wherein said writing end extends at least partially out of the distal end of said body, a cap detachably attached to said proximal end of said body;

a drive rod with a proximal end and a distal end, wherein said drive rod is rotatably fixed to said cap;

a control member slidingly disposed in said cap, wherein said distal end of said drive rod engages said control member; and a biasing element attached to said control member and configured to bias said cartridge in a distal direction, wherein rotation of said drive rod moves said control member within said cap, thereby varying the biasing force against said cartridge;

wherein said control member has a hole therethrough which threads therein, and the distal end of said drive rod has threads that engage the threads of said control member.

21. A writing instrument comprising:

a body having a first part with a distal end and a proximal end, and a second part with a distal end and a proximal end, said proximal end of said first part shaped for detachable coupling to said distal end of said second part, wherein a cavity shaped for receiving a writing instrument cartridge is formed within said first and second parts and is accessible upon decoupling said first and second parts;

a drive rod having a proximal end and a distal end coupled to said second part such that said drive rod is rotatable with respect to said second part without moving longitudinally;

a control member coupled to said drive rod for movement with respect to said drive rod;

wherein:

said control member includes a spring abutment surface;

said cavity within said first and second parts is formed between said distal end of said first part and said spring abutment surface and shaped to receive a spring element and a writing instrument cartridge with the spring element in abutting relation between and against said abutment surface and a butt end of the writing instrument cartridge; and rotation of said drive rod causes linear movement of said control member to shorten the distance between said spring abutment surface and said distal end of said first part.

22. The writing insrtent according to claim 21, further comprising:

a writing instrument cartridge positioned within said cavity, and a spring abuttingly positioned between said control member and said cartridge and configured to bias said cartridge in a distal direction;

wherein rotation of said drive rod moves said control member longitudinally within said secondary to modify compression of said spring between said drive rod and said cartridge, thereby varying the biasing force of said spring against said cartridge.

23. The writing instrument according to claim 22, wherein:

a hollow section is defined within a proximal portion of said second part;

said drive rod further includes a ring section between said proximal and distal ends of said drive rod;

said proximal end of said drive rod extends through said hollow section of said second part and outside said second part, said ring preventing said distal end of said drive rod from extending proximally through said hollow section; and said writing instrument further comprises a drive knob coupled to said proximal end of said drive rod to couple said drive rod to said second part for rotating with respect to said second part without moving longitudinally.

24. The writing instrument according to claim 23, wherein said hollow section of said second part and said control member are shaped and configured such that said control member is non-rotatably positioned within said hollow section of said second part.

25. The writing instrument according to claim 22, wherein a hollow cylinder extends from said spring abutment surface of said control member and is shaped to receive an end of a spring.

26. A method of adjusting the tension of a biasing element against a cartridge element in a writing instrument, said method comprising:

providing a cartridge having a writing end and a buttered within a cavity defined within a writing instrument having a distal part and a proximal part detachably coupled to said distal part, said writing end extending through an opening in said distal part;

extending a drive rod having a distal end and a proximal end through a hole in said proximal part;

providing a control member with an abutment surface it said distal end of said drive rod;

providing a biasing element between and in abutment Keith said butt end of said cartridge and said abutment surface;

moving said drive rod to cause said control member to move toward said cartridge and thereby compress or decompress said biasing element to adjust the biasing force of said biasing element on said cartridge; and compacting said drive rod to said proximal part for rotating without moving longitudinally with respect to said proximal part, said, method further comprising rotating said drive rod to cause said control member to move toward said cartridge.

27. The method of claim 26, further comprising the step of coupling said control member to said drive rod and positioning said control member within said cavity of said writing instrument such that rotation of said drive rod causes longitudinal movement of said control member while said control member is prevented from rotating within said proximal pad, thereby causing said control member to move toward said cartridge.

* * * * *

UNITED STATES PATENT AND TRADEMARK OFFICE

CERTIFICATE OF CORRECTION

PATENT NO. : 6,261,015 B1
DATED : July 17, 2001
INVENTOR(S) : Bernard J. McCauley, Ryan S. Eddington and Michael Huneke It is certified that error appears in the above-identified patent and that said Letters Patent is hereby corrected as shown below:

Column 1,
Line 20, thereof, "it" should be deleted;
Line 39, thereof, "binsing" should be -- biasing --;

Column 5,
Line 13, thereof, "gubstatially" should be -- substantially --;

Column 7,
Line 8, thereof, "buttered" should be -- butt end --;
Line 15, thereof, "it" should be -- at --;
Line 18, thereof, "Keith" should be -- with --.

Signed and Sealed this

Thirtieth Day of April, 2002

*Attest:*

*Attesting Officer*

JAMES E. ROGAN
*Director of the United States Patent and Trademark Office*